US006545478B2

(12) United States Patent
Torres

(10) Patent No.: US 6,545,478 B2
(45) Date of Patent: Apr. 8, 2003

(54) ELECTRONIC IGNITION DEVICE FOR AN ENGINE

(75) Inventor: Antonino Torres, Palermo (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 09/770,764

(22) Filed: Jan. 25, 2001

(65) Prior Publication Data

US 2001/0052775 A1 Dec. 20, 2001

(30) Foreign Application Priority Data

Jan. 27, 2000 (EP) ..... 00830051

(51) Int. Cl.[7] ..... F02P 17/00; F23Q 3/00
(52) U.S. Cl. ..... 324/380; 123/644; 361/257
(58) Field of Search ..... 324/380, 388, 324/378, 399; 123/644; 361/257

(56) References Cited

U.S. PATENT DOCUMENTS 4,454,560 A * 6/1984 Nakao et al. ..... 123/481
5,446,385 A 8/1995 Kugler et al. ..... 324/388

FOREIGN PATENT DOCUMENTS

DE 198 24 254 A1 5/1999
EP 0 740 072 A1 10/1996
EP 0 740 073 A1 10/1996

* cited by examiner

*Primary Examiner*—Christine Oda
*Assistant Examiner*—James Kerveros
(74) *Attorney, Agent, or Firm*—Lisa K. Jorgenson; Robert Iannucci; Seed IP Law Group PLLC

(57) ABSTRACT

The electronic ignition device includes an ignition coil with a primary winding terminal and a secondary winding terminal generating a spark, a power element arranged between the primary winding terminal and ground, a protection circuit issuing a disable signal to the control terminal of the power element in preset conditions, and a voltage limiting circuit having inputs connected to the primary winding terminal and to the battery voltage, and an output connected to the control terminal of the power element. The voltage limiting circuit detects a potential difference between its own inputs and supplies to the control terminal an activation signal for the power element, in presence of the deactivation signal and when the potential difference exceeds the supply voltage by a preset value. Thereby, the voltage limiting circuit limits the voltage on the primary winding terminal to a preset value which depends upon the value of the battery voltage.

21 Claims, 5 Drawing Sheets

ELECTRONIC IGNITION DEVICE FOR AN ENGINE

TECHNICAL FIELD

The present invention regards an electronic ignition device with limitation of the voltage at an ignition coil primary winding terminal.

BACKGROUND OF THE INVENTION

As is known, one of the problems present in electronic ignition devices for inductive loads is to limit the voltage at the primary winding terminal of the ignition coil, in the event of a malfunctioning of the device being detected, so as to prevent an ignition spark from being generated on the secondary winding terminal of the same coil.

In this connection, FIG. 1 shows a schematic circuit diagram of an electronic ignition device 1 comprising an ignition coil 2 and a power element 3, for example an IGBT or a bipolar power transistor. In greater detail, the ignition coil 2 includes a primary winding 2*a* and a secondary winding 2*b*; a first terminal 2*c* of the primary and secondary windings 2*a*, 2*b* is connected to a supply line 4, set at a battery voltage $V_B$, a second terminal 5 of the primary winding 2*a* is connected to a collector terminal of the power element 3, and a second terminal 6 of the secondary winding 2*b* is connected to a spark plug (not shown in FIG. 1) which generates the ignition spark. The power element 3 has an emitter terminal 7 connected to ground GND and a control terminal 8 connected to a microprocessor 9, shown only schematically in FIG. 1, through a resistor 10. A high voltage Zener diode 25 has its cathode connected to the second terminal 5 of the primary winding 2*a* and its anode connected to the control terminal 8 of the power element 3. The high voltage Zener diode 25 limits the maximum voltage applied to the second terminal 5 of the primary winding 2*a* to prevent the latter from exceeding the breakdown voltage of the power device 1.

The microprocessor 9 controls turning on of the power element 3 by supplying, to the control terminal 8 of the latter, a trigger signal at a high logic level (FIG. 2). Upon turning on of the power element 3, across the primary winding 2*a* a voltage is applied that is close to the battery voltage $V_B$. Consequently, a primary current $I_{out}$ starts flowing in the terminal of the primary winding 5 (FIG. 2).

Once an appropriate time has elapsed during which the primary current $I_{out}$ reaches a preset value $I_o$ (charging time of the ignition coil 2), the microprocessor 9 controls turning off of the power device 3 by sending the trigger signal to a low logic level. In this condition, a voltage pulse $V_O$, is generated at the second terminal 5 of the primary winding 2*a* (FIG. 2); the voltage pulse, transferred onto the second terminal of the secondary winding 2*b* multiplied by the turn ratio of the ignition coil 2, gives rise to a spark.

In an electronic ignition device of the type described above, it is necessary that the spark is generated only when the microprocessor 9 turns off the power element 3 by sending the trigger signal to the low logic level. However, in the event of malfunctioning of the device, it may be necessary to turn off the power element 3 independently of the logic level of the trigger signal and without a spark being produced on the second terminal 6 of the secondary winding 2*b*.

As shown in FIG. 3, to meet this requirement, the electronic ignition device 1 is provided with a protection circuit 11, shown only schematically in FIG. 3, for detecting anomalous operating conditions of the electronic ignition device 1, such as overheating of the power element 3 or exceeding the preset current value $I_o$, and supplying, at an output terminal 16, a logic signal EN used as enable signal for a voltage limiting circuit 12.

In greater detail, the voltage limiting circuit 12 has a first input terminal 13, a second input terminal 14, and an output terminal 15. The first input terminal 13 of the voltage limiting circuit 12 is connected to the second terminal 5 of the primary winding 2*a*; the second input terminal 14 of the voltage limiting circuit 12 is connected to the output terminal 16 of the protection circuit 11 through an inverter 17; and the output terminal 15 of the voltage limiting circuit 12 is connected to the control terminal 8 of the power element 3.

The voltage limiting circuit 12 comprises an enable transistor 18 of the NPN type, having a collector terminal connected to the first input terminal 13 of the voltage limiting circuit 12 through a high voltage resistor 19, an emitter terminal connected to ground GND, and a control terminal connected to the second input terminal 14 of the voltage limiting circuit 12.

The voltage limiting circuit 12 further comprises a first high voltage vertical transistor 20*a* and a second high voltage vertical transistor 20*b* , both of the NPN type and coupled in Darlington configuration. In particular, the first high voltage vertical transistor 20*a* has a collector terminal connected to the first input terminal 13 of the voltage limiting circuit 12, a control terminal connected to the collector terminal of the enable transistor 18 through a first circuit node 30, and an emitter terminal. The second high voltage vertical transistor 20*b* has a collector terminal connected to the first input terminal 13 of the voltage limiting circuit 12, a control terminal connected to the emitter terminal of the first transistor 20*a* , and an emitter terminal connected to the output terminal 15 of the voltage limiting circuit 12 through a Zener diode 22. The Zener diode 22 has its cathode connected to the emitter terminal of the second transistor 20*b* and its anode connected to the output terminal 15 of the voltage limiting circuit 12. A resistive element 21 is connected between the control terminal and the emitter terminal of the second high voltage vertical transistor 20*b*.

The electronic ignition device 1 further comprises a protection transistor 23 having a collector terminal connected to the control terminal 8 of the power element 3 via a second circuit node 31, an emitter terminal connected to ground GND, and a control terminal connected to the output terminal 16 of the protection circuit 11.

A biasing resistor 24 is coupled between the second circuit node 31 and the output terminal 15 of the voltage limiting circuit 12.

After detecting a malfunctioning of the electronic ignition device 1, the protection circuit 11 generates, on the control terminal of the protection transistor 23, a high logic level of the logic signal EN. Consequently, the protection transistor 23 saturates, generating on the second circuit node 31 a voltage $V_{cesat}$ equal to its own saturation voltage (voltage present between the collector and the emitter terminal of the protection transistor 23 in saturation) and determining turning off of the power element 3, with consequent increase in the voltage on the second terminal 5 of the primary winding 2*a*.

At the same time, the inverter 17 generates, on the control terminal of the enable transistor 18, a logic signal, correlated to the logic signal EN, at a low logic level. Consequently, the enable transistor 18 turns off, generating on the first circuit node 30 a voltage that turns on the high voltage vertical transistors 20*a* and 2*b*. These transistors supply the Zener diode 22 and the biasing resistor 24 with a current that causes a biasing voltage VP across the biasing resistor 24. The biasing voltage VP causes turning on again of the power element 3, which maintains the voltage on the second terminal 5 of the primary winding 2*a* at a value VL that maintain the high voltage vertical transistors 20*a* , 20*b* on, so that the latter continue to supply current until complete exhaustion of the energy stored in the primary winding 2*a* of the ignition coil 2. In particular, the value $V_L$ is $$V_L=V_R+V_{be1}+V_{be2}+V_Z+V_P+V_{ceat} \quad (1)$$

wherein $V_R$ is the voltage across the high voltage resistor 19, $V_{be1}$ and $V_{be2}$ are the voltages between the control and the emitter terminals of the high voltage vertical transistors 20*a*, 20*b* , and $V_z$ is the voltage across the Zener diode 22.

At the end of the discharge of the ignition coil, the voltage $V_L$ reaches the value of battery voltage $V_B$. In these conditions, for proper operation of the voltage limiting circuit 12, the high voltage vertical transistors 20*a* , 20*b* must be off. This occurs only if the voltage $V_z$ satisfies the following condition:

$$V_Z>V_B\ V_R\ V_{be1}\ V_{be2}\ V_P\ V_{cesat} \quad (2)$$

which is obtained from relation (1) setting $V_L=V_B$.

Consequently, on the basis of relation (2), in order to have proper operation of the voltage limiting circuit 12, the Zener diode 22 must be chosen each time according to the maximum battery voltage $V_B$ envisaged in the specifications.

In addition, in applications for electronic ignition that require a preset maximum value of 24 V for the battery voltage $V_B$, the value of the voltage $V_L$ may be too high if the coil has a high turn ratio between its primary and its secondary windings; consequently, an undesired spark may be generated.

SUMMARY OF THE INVENTION

According to the principles of the invention, an electronic ignition device includes an ignition coil having a primary winding terminal and a secondary winding terminal generating a spark. A power element is arranged between the primary winding terminal and ground. A protection circuit issues a disable signal to the control terminal of the power element under preset conditions. A voltage limiting circuit having inputs connected to the primary winding terminal and to the battery voltage, and an output connected to the control terminal of the power element is provided. The voltage limiting circuit detects a potential difference between its own inputs, and supplies to the control terminal an activation signal for the power element, in presence of the deactivation signal and when the potential difference exceeds the supply voltage by a preset value. Thereby, the voltage limiting circuit limits the voltage on the primary winding terminal to a preset value, which depends upon the value of the battery voltage.

BRIEF DESCRIPTION OF THE DRAWINGS

The features and advantages of the electronic ignition device according to the invention will emerge clearly from the following description of an embodiment, given only as a non-limiting example, with reference to the attached drawings, wherein.

DETAILED DESCRIPTION OF THE INVENTION

Figure 4:
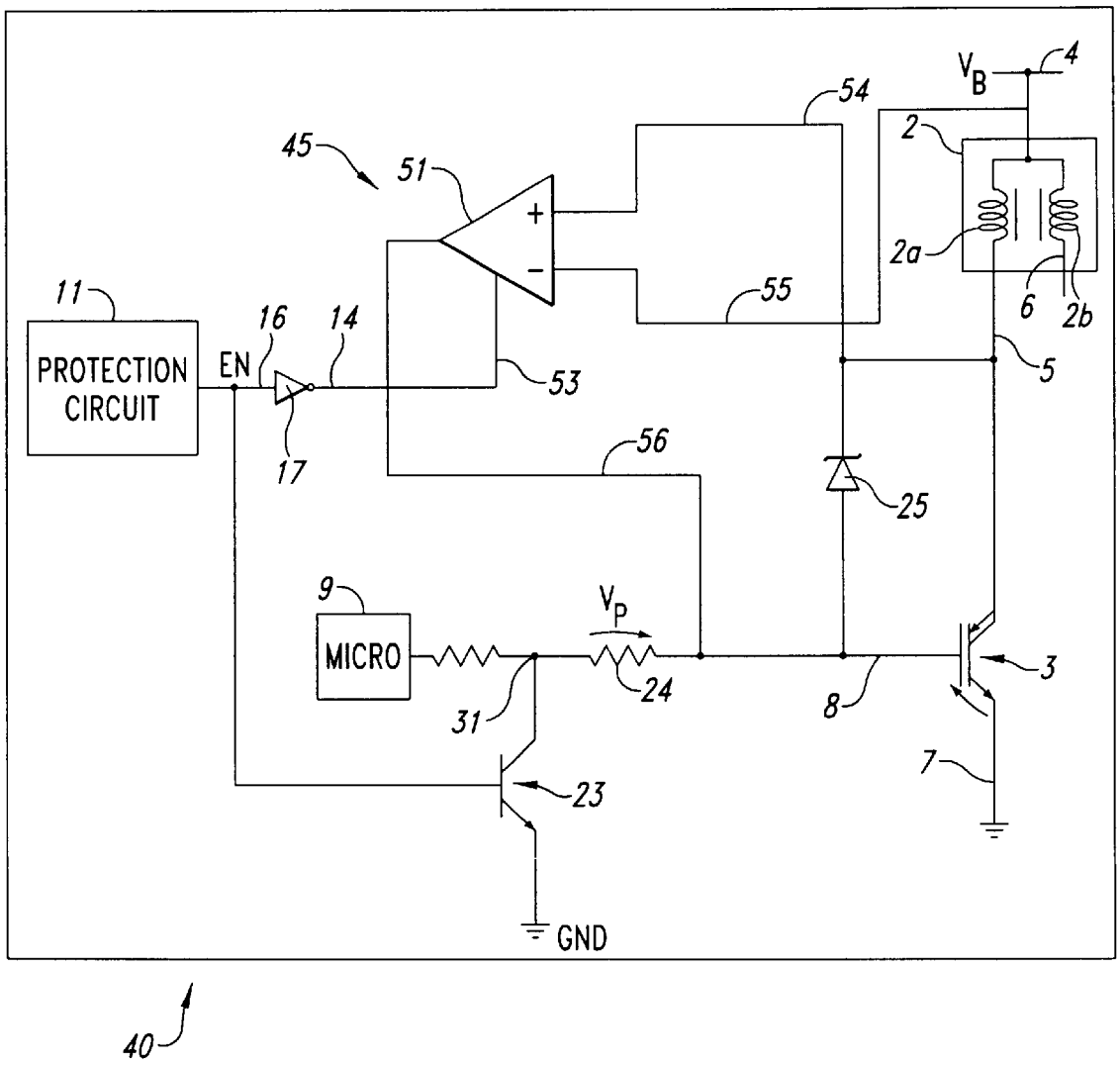
FIG. 4 shows a circuit diagram of an electronic ignition device according to the invention.

FIG. 4 shows the circuit diagram of an electronic ignition device 50 according to the invention, comprising a voltage limiting circuit 45 which, in a preferred embodiment comprises an operational amplifier 51.

The operational amplifier 51 has an enable terminal 53 connected, through the inverter 17, to the output terminal 16 of the protection circuit 11, a non-inverting terminal 54, connected to the second terminal 5 of the primary winding 2*a* , an inverting terminal 55 connected to the supply line 4, and an output terminal 56 connected to the control terminal 8 of the power element 3.

Figure 1:
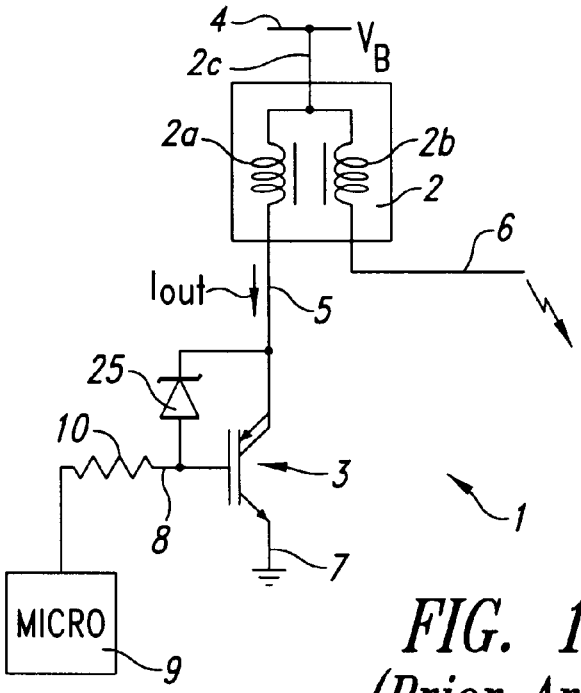
FIG. 1 (Prior Art)
FIG. 1 is a schematic circuit diagram of a known electronic ignition device.
Figure 2:
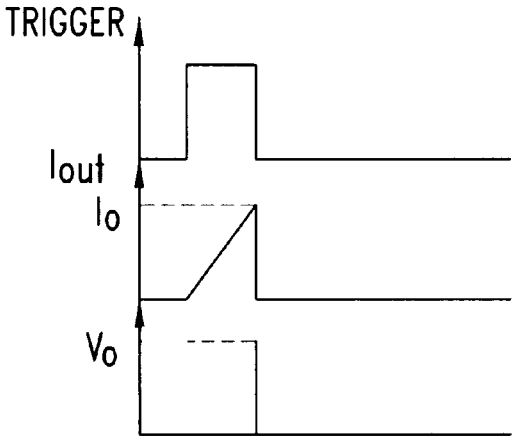
FIG. 2 (Prior Art)
FIG. 2 shows the plots of electrical quantities taken on the device of FIG. 1.
Figure 3:
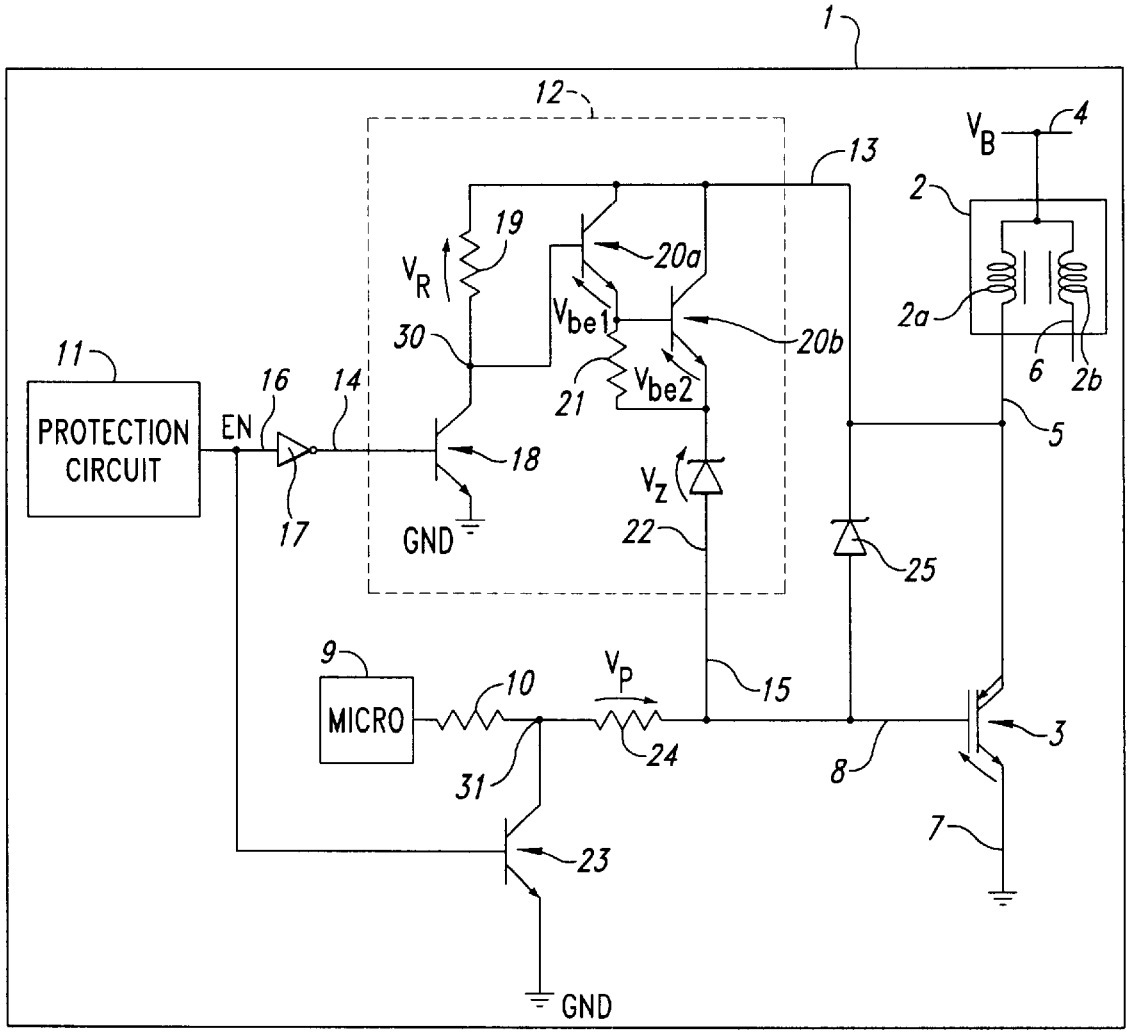
FIG. 3 (Prior Art)
FIG. 3 presents a more complete circuit diagram of the electronic ignition device of FIG. 1.

The other parts of the electronic ignition device 50 are the same as those of the known electronic ignition device 1 shown in FIGS. 1 and 3; consequently, they are designated by the same reference numbers and need not be described any further.

Figure 5:
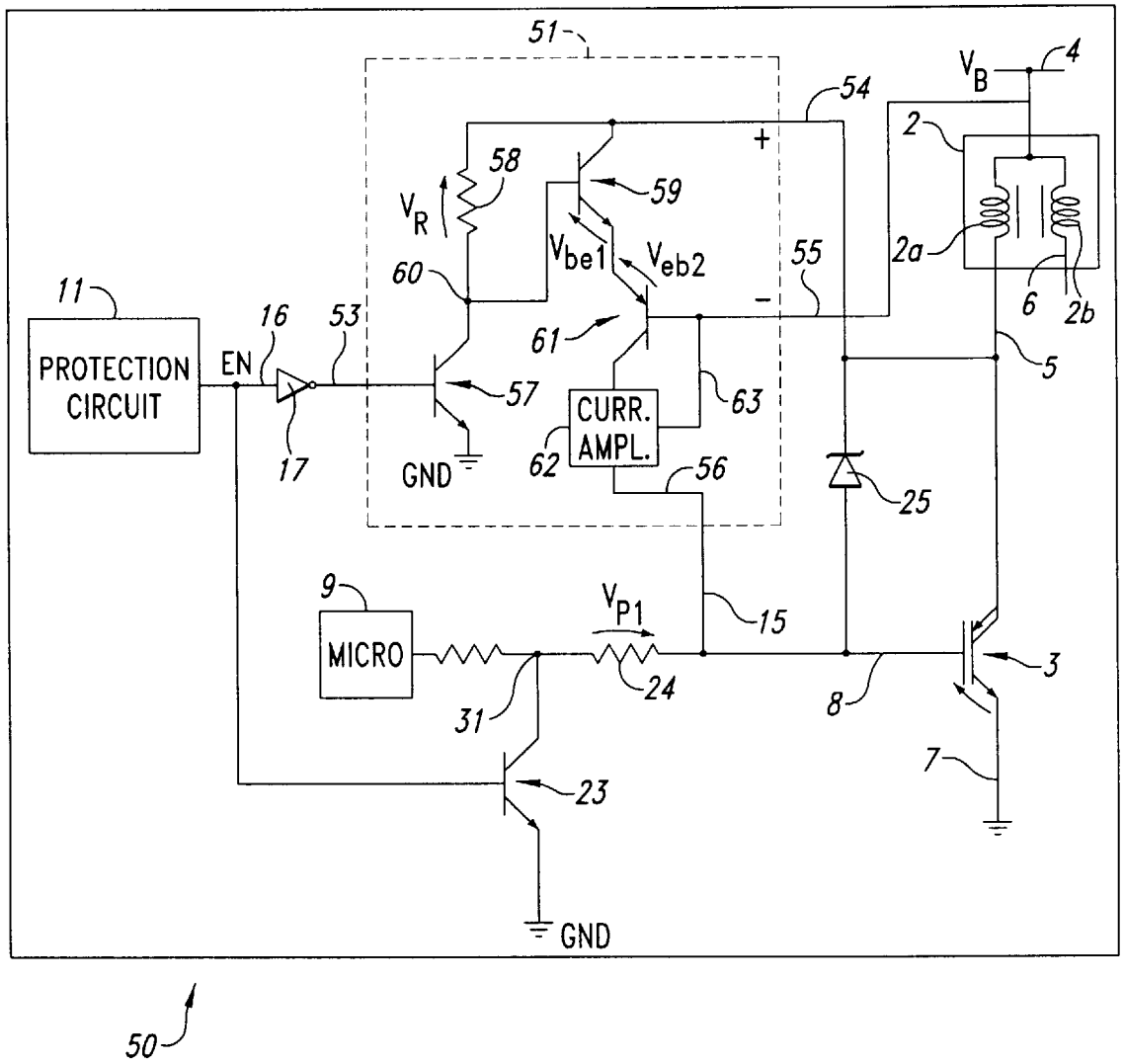
FIG. 5 shows a more detailed circuit diagram of an electronic ignition device according to the invention.

According to the preferred embodiment, as shown in FIG. 5, the operational amplifier 51 comprises an NPN type enable transistor 57 having a collector terminal connected to the non-inverting terminal 54 through a high voltage resistor 58, an emitter terminal connected to ground GND, and a control terminal connected to the enable terminal 53.

The operational amplifier 51 further comprises an NPN type high voltage vertical transistor 59 having a collector terminal connected to the non-inverting terminal 54, a control terminal connected, at a first circuit node 60, to the collector terminal of the enable transistor 57, and an emitter terminal.

A PNP type error transistor 61 defining an error amplifier has an emitter terminal connected to the emitter terminal of the high voltage vertical transistor 59, a control terminal connected to the inverting terminal 55, and a collector terminal connected to the output terminal 56 through a current amplifier block 62, illustrated only schematically in FIG. 4 and per se known.

The current amplifier block 62 has a supply terminal 63 connected to the inverting terminal 55.

Figure 6:
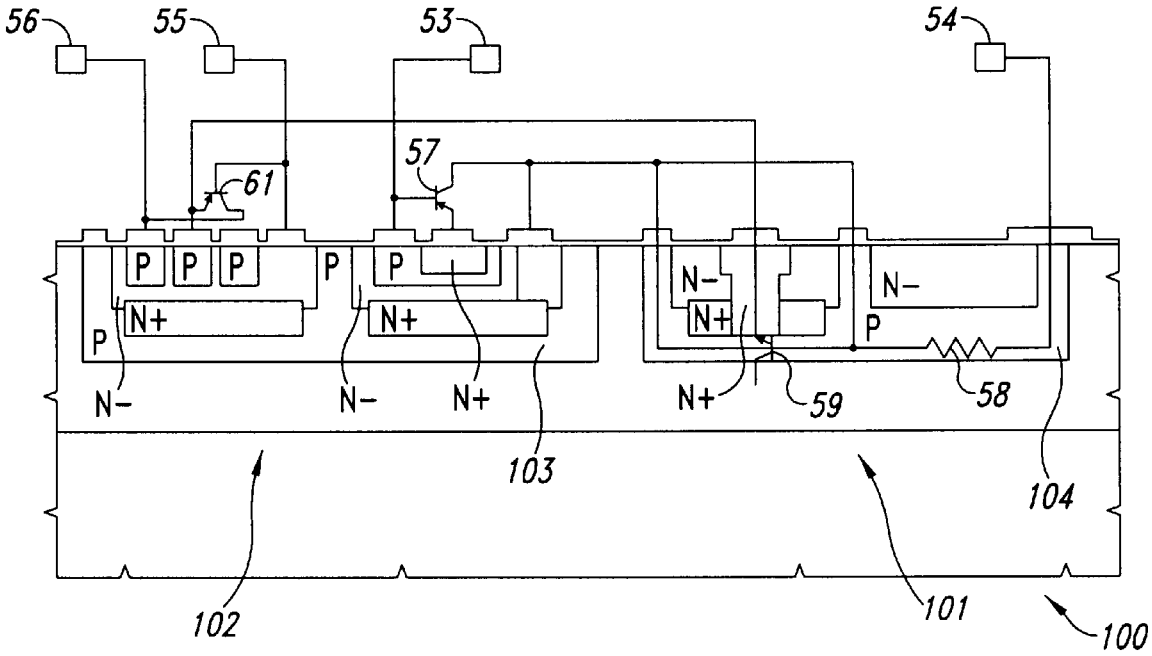
FIG. 6 shows a cross-section through a chip incorporating a portion of the electronic ignition device of FIG. 4.

As shown in FIG. 6, the operational amplifier 51 is implemented using a VIPOWER™ technology, which enables integrating, in a same chip 100, a high voltage circuit portion 101 of the operational amplifier 51 and a low voltage circuit portion 102 of the operational amplifier 51, which are separated from each other by an isolation region 103 having P-type conductivity. In greater detail, the high voltage circuit portion 101 accommodates the high voltage vertical transistor 59 and the high voltage resistor 58, the latter being made as a prolongation of a base region 104 belonging to the high voltage vertical transistor 59. The low voltage circuit portion 102 accommodates the enable transistor 57 and the error transistor 61 as well as the current amplifier block 62 (not shown in FIG. 6).

Operation of the electronic ignition device 50 of FIG. 4 is described hereinbelow.

Similarly to the above, the protection circuit 11, after detecting a malfunctioning of the electronic ignition device 50, generates, at the output terminal 16 of the protection circuit 11, a high logic level of the logic signal EN, thus turning off the power element 3 and enabling the voltage limiting circuit 45.

Once enabled, the voltage limiting circuit 45 operates so as to maintain its own input terminals 54, 55 at the same potential and supplies on its own output terminal 56 a current which determines, across the biasing resistor 24, a biasing voltage $V_{pl}$ which causes the power element 3 to turn on again; the latter, in turn, limits the voltage on the second terminal 5 of the primary winding 2*a* to a value equal to that of the battery voltage $V_B$.

In greater detail, the inverter 17 generates, on the control terminal of the enable transistor 57, a logic signal, correlated to the logic signal EN, at a low logic level. Consequently, the enable transistor 57 turns off, thus enabling the current through the high voltage resistor 58 to flow in the control terminal of the high voltage vertical transistor 59, so turning it on. The current supplied by the high voltage vertical transistor 59 flows in the error transistor 61 and, after being amplified by the current amplifier block 62, is injected into the biasing resistor 24, so generating the biasing voltage $V_{p1}$, which, as mentioned, turns on again the power element 3 and limits the voltage on the non-inverting terminal of the operational amplifier 51. In practice, a negative feedback is created, whereby the voltage on the second terminal 5 of the primary winding 2*a* is limited to a value $V_{L1}$ according to the following equation:

$$V_{L1}=V_R+V_{be1}+V_{eb2}+V_B \quad (3)$$

where $V_R$ is the voltage present across the high voltage resistor 58, $V_{be1}$ is the emitter-to-control terminal voltage of the high voltage vertical transistor 59, $V_{eb2}$ is the emitter-to-control terminal voltage of the error transistor 61, and $V_B$ is the battery voltage.

From the above, it is clear that the electronic ignition device 50 is a negative feedback device in which the error transistor 61 detects, between its emitter and control terminals, the voltage difference existing between the second terminal 5 of the primary winding 2*a* and the supply line 4 (battery voltage $V_B$ ), and supplies, on its own collector terminal, a current controlling the power element 3 so that the voltage at the second terminal 5 of the primary winding 2*a* is not able to exceed $V_{L1}$, according to relation (3).

The current amplifier block 62 has the purpose of reducing to the utmost the current flowing in the collector terminals of the high voltage vertical transistor 59 and of the error transistor 61 so as to enable the use of components having minimal dimensions; in addition, it minimizes the current flowing in the control terminal of the high voltage vertical transistor 59 and, consequently, the voltage $V_{R1}$ across the high voltage resistor 58.

Furthermore, the action of the current amplifier block 62 is particularly important when the power element 3 is a bipolar power transistor, which requires, on its control terminal, an adequate current for turning on again during limitation.

In normal operating conditions of the electronic ignition device 50, the protection circuit 11 maintains the logic signal EN at a low logic level. The protection transistor 23 is therefore off, whereas the activation transistor 57, in so far as it has a logic signal at a high logic level on its control terminal, is saturated and turns off the high voltage vertical transistor 59. In this way, the error transistor 61 does not supply any current to the biasing resistor 24, and the electronic ignition device 50 can operate regularly, as described above.

The electronic ignition device 50 described herein has the following advantages. First, unlike the known voltage limiting circuit, wherein it is necessary to use each time a Zener diode 22 correlated to the maximum value selected for the battery voltage $V_B$, the present voltage limiting circuit 45 is able to adapt automatically to the maximum value of the battery voltage $V_B$, without any need for modifying the circuit.

In fact, the voltage limiting circuit 45 is always able to limit the voltage present on the second terminal 5 of the primary winding 2*a* to a voltage value $V_{L1}$, irrespective of the value of the battery voltage $V_B$. The value of the voltage $V_{L1}$ is also such as to prevent a spark forming on the second terminal 6 of the secondary winding 2*b* of the ignition coil.

Furthermore, the voltage limiting circuit 45 comprises a single high voltage transistor 59; in addition, it has smaller dimensions than the high voltage vertical transistor included in the known voltage limiting circuit. Thereby, the size of the voltage limiting circuit 51 according to the invention is considerably reduced.

While the voltage limiting device 45 has been described as including an operational amplifier, any circuit or components that serve to control the voltage level at the second terminal 5 of the primary winding by comparing it with the supply line voltage, is acceptable. For example, a digital comparator that receives and outputs signals in digital form may be used, as well as other feedback circuits.

Finally, it is clear that numerous variations and modifications may be made to the electronic ignition device described and illustrated herein, all falling within the scope of the invention, as defined in the attached claims. In particular, it is emphasized that the specific implementation shown in FIG. 5 is merely presented as an example.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. An electronic ignition device comprising:

an ignition coil having a supply terminal connected to a supply line set at a supply voltage, a primary winding terminal, and a secondary winding terminal generating a spark;

a power element having a first and a second conduction terminals and a power control terminal, the first and second conduction terminals connected, respectively, to said primary winding terminal and to a reference node;

a disabling circuit having a disable terminal coupled to said power control terminal of said power element, said disabling circuit generating, on said power control terminal, a disabling signal for said power element;

a voltage limiting circuit having an enable terminal connected to said disable terminal of said disabling circuit, a first input terminal connected to said primary winding terminal, a second input terminal connected to said supply line, and an output terminal connected to said power control terminal said voltage limiting circuit detecting a potential difference present between said first input terminal and said second input terminal, and generating, in presence of said disabling signal, an activation signal of a preset relation to said potential difference between said first input terminal and said second input terminal, on said power control terminal; and a feedback loop structured from the first and second input terminals of the primary winding to drive the voltage limiting circuit and to control the power control terminal of the power element such that the first conduction terminal of the power element is maintained at the supply voltage.

2. The electronic ignition device according to claim 1, wherein said voltage limiting circuit generates said activation signal when said potential difference exceeds a preset value.

3. The electronic ignition device according to claim 2, wherein said voltage limiting circuit comprises an operational amplifier, having an inverting input comprising said second input terminal, a non-inverting input comprising said first input terminal, and an output terminal comprising said output terminal of said voltage limiting device.

4. The electronic ignition device according to claim 3, wherein said operational amplifier comprises a first and a second transistor connected in series between said first input terminal and said output terminal of said voltage limiting circuit, said first transistor having a control terminal coupled to said enable terminal, and said second transistor having a control terminal connected to said second input terminal.

5. The electronic ignition device according to claim 4, further comprising a current amplifier block arranged in series between said second transistor and said output terminal of said voltage limiting circuit.

6. The electronic ignition device according to claim 4, wherein said control terminal of said first transistor is coupled to said disable terminal of said disabling circuit through a third transistor, said third transistor having a first conduction terminal connected to said control terminal of said first transistor, a second conduction terminal connected to said reference node, and a control terminal connected to said disable terminal of said disabling circuit.

7. The electronic ignition device according to claim 6, wherein said first transistor is a high voltage NPN vertical transistor, said second transistor is a PNP transistor, and said third transistor is an NPN transistor.

8. The electronic ignition device according to claim 6, wherein said first, second and third transistors are integrated in a single chip of semiconductor material.

9. A method comprising:

sensing a malfunction in an electronic ignition circuit;

disabling said circuit;

preventing an ignition coil, having a primary and a secondary winding, from generating a voltage pulse on the secondary winding as a result of the disable step, by holding a first voltage level, present at a first terminal of said primary winding, equal to a second voltage level, present at a second terminal of said primary winding.

10. The method according to claim 9, wherein a power device is connected in series with said primary winding, between said first terminal and a ground reference terminal.

11. The method according to claim 10, wherein the step of preventing said coil from generating a voltage pulse further comprises the steps of:

comparing said first voltage level to said second voltage level;

generating a third voltage level that is proportionate to a difference of said first and second voltage levels;

connecting said third voltage level to a control terminal of said power device, such that said power conducts proportional with the value of said third voltage level.

12. The method according to claim 11, wherein said comparison is performed by a comparator circuit, having a first input terminal connected to said first terminal, a second input terminal connected to said second terminal, and an output terminal connected to said control terminal.

13. An ignition protection circuit, comprising:

an ignition coil including a primary and secondary winding, the primary and secondary windings each having a first terminal coupled at a first supply;

a power stage having first, second and control terminals, the first terminal coupled to a second terminal of the primary winding of the ignition coil and the second terminal of the power stage coupled to a second supply; and a feedback circuit having a first terminal coupled to the first supply and a second terminal coupled to the second terminal of the primary winding of the ignition coil, an output terminal coupled to the control terminal of the power stage such that the power stage is controllably discharged.

14. The ignition protection circuit according to claim 13 wherein the first supply is a battery having a supply voltage range that decreases over time and the feedback circuit is able to controllably discharge the ignition coil over the supply voltage range.

15. The ignition protection circuit according to claim 13 wherein the feedback circuit an operational amplifier.

16. The ignition protection circuit according to claim 13 wherein the power stage comprises a power transistor.

17. An ignition control device, comprising:

an ignition coil having primary and secondary windings, each winding includes a first terminal coupled to a first supply such that a potential difference above a spark threshold is received across the secondary winding;

a power switch having first, second and control terminals, the first terminal of the power switch is coupled to the second terminal of the primary winding of the ignition coil and the second terminal of the power switch coupled to a second supply;

a protection circuit having first, second and control terminals, the first terminal coupled to the control terminal of the power switch, the second terminal coupled to the second supply, and the control terminal of the protection circuit coupled to an enable signal to turn off the power switch; and a feedback control circuit having first and second input terminals to receive a potential difference across the primary winding, an enable input receiving the enable signal, and an output terminal to provide a control signal to the control terminal of the power switch to maintain the potential difference across the primary winding constant and maintain the potential difference across the secondary winding below the spark threshold, when the protection circuit outputs the enable signal.

18. The ignition protection circuit according to claim 17 wherein the first supply is a battery having a supply voltage range that decreases over time and the feedback control circuit is able to maintain constant the potential difference across the primary winding of the ignition coil over the supply voltage range.

19. The ignition control device of claim 17 wherein the protection circuit further comprises a means for generating the enable signal upon the detection of a malfunction condition.

20. The ignition control device of claim 17 wherein the feedback control circuit further comprises a bias resistor coupled between the first terminal of the protection circuit and the control terminal of the power switch.

21. The ignition control device of claim 17 wherein the feedback control circuit generates the control signal when the potential difference exceeds a predetermined potential.

* * * * *